US007891760B2

(12) United States Patent
Karppinen et al.

(10) Patent No.: US 7,891,760 B2
(45) Date of Patent: Feb. 22, 2011

(54) PRINTHEAD MAINTENANCE STATION INCORPORATING A DABBING DEVICE

(75) Inventors: Vesa Karppinen, Balmain (AU); Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 249 days.

(21) Appl. No.: 12/142,774

(22) Filed: Jun. 20, 2008

(65) Prior Publication Data

US 2008/0246802 A1 Oct. 9, 2008

Related U.S. Application Data

(63) Continuation of application No. 11/246,693, filed on Oct. 11, 2005, now Pat. No. 7,401,887.

(51) Int. Cl.
*B41J 2/185* (2006.01)

(52) U.S. Cl. ..... 347/31

(58) Field of Classification Search ..... None
See application file for complete search history.

(56) References Cited

U.S. PATENT DOCUMENTS

| | | | | |
|---|---|---|---|---|
| 4,367,479 A | | 1/1983 | Bower | |
| 4,928,120 A | * | 5/1990 | Spehrley et al. | 347/33 |
| 5,381,168 A | | 1/1995 | Kondo et al. | |
| 5,448,271 A | | 9/1995 | Yamaguchi et al. | |
| 5,559,536 A | | 9/1996 | Saito et al. | |
| 6,206,499 B1 | | 3/2001 | Iijima et al. | |
| 6,663,230 B2 | | 12/2003 | Asakawa et al. | |
| 6,695,429 B2 | * | 2/2004 | Barinaga | 347/28 |
| 6,913,340 B2 | | 7/2005 | Tanaka et al. | |
| 6,916,080 B2 | * | 7/2005 | Okamoto | 347/29 |
| 2004/0041875 A1 | | 3/2004 | Yazawa et al. | |

FOREIGN PATENT DOCUMENTS

| | | |
|---|---|---|
| DE | 20318248 | 2/2004 |
| DE | 20318248 U1 | 4/2004 |
| EP | 0362897 B1 | 2/1997 |
| EP | 1005997 | 6/2000 |
| EP | 1077133 | 2/2001 |
| EP | 1470922 A2 | 10/2004 |
| JP | 2004-058348 A | 0/2004 |
| JP | 2003-001858 A | 1/2003 |
| JP | 2003-326739 A | 11/2003 |
| JP | 2005-225163 A | 8/2005 |
| WO | WO 00/68016 | 11/2000 |

* cited by examiner

*Primary Examiner*—Matthew Luu
*Assistant Examiner*—Alejandro Valencia

(57) ABSTRACT

Provided is a printhead maintenance station for a pagewidth printer. The maintenance station includes a capper having an open-ended capping chamber with a perimeter gasket for operatively engaging with a printhead of the printer to form a protective seal around the printhead. The station also includes an engagement mechanism configured to actuate said capper into and out of sealing engagement with the printhead. Also included is a dabbing device with a microfiber film which is operatively fed between a pair of spools to dab a non-printing portion of the printhead after the capper is disengaged from the printhead.

7 Claims, 5 Drawing Sheets

PRINTHEAD MAINTENANCE STATION INCORPORATING A DABBING DEVICE

CROSS REFERENCE TO RELATED APPLICATION

This application is a continuation application of U.S. application Ser. No. 11/246,693 filed on Oct. 11, 2005 all of which are herein incorporated by reference.

FIELD OF THE INVENTION

This invention relates to a printhead maintenance assembly for an inkjet printhead. It has been developed primarily for facilitating maintenance operations, such as cleaning particulates from an ink ejection face of the printhead.

CO-PENDING APPLICATIONS

The following applications have been filed by the Applicant simultaneously with the present application:

| | | | | | |
|---|---|---|---|---|---|
| 11/246,676 | 11/246,677 | 11/246,678 | 11/246,679 | 11/246,680 | 11/246,681 |
| 11/246,714 | 11/246,713 | 11/246,689 | 11/246,671 | 11/246,670 | 11/246,669 |
| 11/246,704 | 11/246,710 | 11/246,688 | 11/246,716 | 11/246,715 | 11/246,707 |
| 11/246,706 | 11/246,705 | 11/246,708 | 11/246,693 | 11/246,696 | 11/246,695 |
| 11/246,694 | 11/246,687 | 11/246,718 | 7,322,681 | 11/246,686 | 11/246,703 |
| 11/246,691 | 11/246,711 | 11/246,690 | 11/246,712 | 11/246,717 | 11/246,709 |
| 11/246,700 | 11/246,701 | 11/246,702 | 11/246,668 | 11/246,697 | 11/246,698 |
| 11/246,699 | 11/246,675 | 11/246,674 | 11/246,667 | 7,303,930 | 11/246,672 |
| 11/246,673 | 11/246,683 | 11/246,682 | | | |

The disclosures of these co-pending applications are incorporated herein by reference.

CROSS REFERENCES TO RELATED APPLICATIONS

Various methods, systems and apparatus relating to the present invention are disclosed in the following US Patents/Patent Applications filed by the applicant or assignee of the present invention:

| | | | | | |
|---|---|---|---|---|---|
| 6,750,901 | 6,476,863 | 6,788,336 | 7,249,108 | 6,566,858 | 6,331,946 |
| 6,246,970 | 6,442,525 | 7,346,586 | 09/505,951 | 6,374,354 | 7,246,098 |
| 6,816,968 | 6,757,832 | 6,334,190 | 6,745,331 | 7,249,109 | 7,197,642 |
| 7,093,139 | 10/636,263 | 10/636,283 | 10/866,608 | 7,210,038 | 10/902,883 |
| 10/940,653 | 10/942,858 | 7,364,256 | 7,258,417 | 7,293,853 | 7,328,968 |
| 7,270,395 | 11/003,404 | 11/003,419 | 7,334,864 | 7,255,419 | 7,284,819 |
| 7,229,148 | 7,258,416 | 7,273,263 | 7,270,393 | 6,984,017 | 7,347,526 |
| 7,357,477 | 11/003,463 | 7,364,255 | 7,357,476 | 11/003,614 | 7,284,820 |
| 7,341,328 | 7,246,875 | 7,322,669 | 11/246,692 | 6,623,101 | 6,406,129 |
| 6,505,916 | 6,457,809 | 6,550,895 | 6,457,812 | 7,152,962 | 6,428,133 |
| 7,204,941 | 7,282,164 | 10/815,628 | 7,278,727 | 10/913,373 | 10/913,374 |
| 10/913,372 | 7,138,391 | 7,153,956 | 10/913,380 | 10/913,379 | 10/913,376 |
| 7,122,076 | 7,148,345 | 11/172,816 | 11/172,815 | 11/172,814 | 10/407,212 |
| 7,252,366 | 10/683,064 | 7,360,865 | 6,746,105 | 7,156,508 | 7,159,972 |
| 7,083,271 | 7,165,834 | 7,080,894 | 7,201,469 | 7,090,336 | 7,156,489 |
| 10/760,233 | 10/760,246 | 7,083,257 | 7,258,422 | 7,255,423 | 7,219,980 |
| 10/760,253 | 10/760,255 | 10/760,209 | 7,118,192 | 10/760,194 | 7,322,672 |
| 7,077,505 | 7,198,354 | 7,077,504 | 10/760,189 | 7,198,355 | 10/760,232 |
| 7,322,676 | 7,152,959 | 7,213,906 | 7,178,901 | 7,222,938 | 7,108,353 |
| 7,104,629 | 7,246,886 | 7,128,400 | 7,108,355 | 6,991,322 | 7,287,836 |
| 7,118,197 | 10/728,784 | 7,364,269 | 7,077,493 | 6,962,402 | 10/728,803 |
| 7,147,308 | 10/728,779 | 7,118,198 | 7,168,790 | 7,172,270 | 7,229,155 |
| 6,830,318 | 7,195,342 | 7,175,261 | 10/773,183 | 7,108,356 | 7,118,202 |
| 10/773,186 | 7,134,744 | 10/773,185 | 7,134,743 | 7,182,439 | 7,210,768 |
| 10/773,187 | 7,134,745 | 7,156,484 | 7,118,201 | 7,111,926 | 10/773,184 |
| 7,018,021 | 11/060,751 | 11/060,805 | 11/188,017 | 11/097,308 | 11/097,309 |
| 7,246,876 | 11/097,299 | 11/097,310 | 11/097,213 | 7,328,978 | 7,334,876 |

-continued

| | | | | | |
|---|---|---|---|---|---|
| 7,147,306 | 09/575,197 | 7,079,712 | 6,825,945 | 7,330,974 | 6,813,039 |
| 6,987,506 | 7,038,797 | 6,980,318 | 6,816,274 | 7,102,772 | 7,350,236 |
| 6,681,045 | 6,728,000 | 7,173,722 | 7,088,459 | 09/575,181 | 7,068,382 |
| 7,062,651 | 6,789,194 | 6,789,191 | 6,644,642 | 6,502,614 | 6,622,999 |
| 6,669,385 | 6,549,935 | 6,987,573 | 6,727,996 | 6,591,884 | 6,439,706 |
| 6,760,119 | 7,295,332 | 6,290,349 | 6,428,155 | 6,785,016 | 6,870,966 |
| 6,822,639 | 6,737,591 | 7,055,739 | 7,233,320 | 6,830,196 | 6,832,717 |
| 6,957,768 | 09/575,172 | 7,170,499 | 7,106,888 | 7,123,239 | 10/727,181 |
| 10/727,162 | 10/727,163 | 10/727,245 | 7,121,639 | 7,165,824 | 7,152,942 |
| 10/727,157 | 7,181,572 | 7,096,137 | 7,302,592 | 7,278,034 | 7,188,282 |
| 10/727,159 | 10/727,180 | 10/727,179 | 10/727,192 | 10/727,274 | 10/727,164 |
| 10/727,161 | 10/727,198 | 10/727,158 | 10/754,536 | 10/754,938 | 10/727,160 |
| 10/934,720 | 7,171,323 | 10/296,522 | 6,795,215 | 7,070,098 | 7,154,638 |
| 6,805,419 | 6,859,289 | 6,977,751 | 6,398,332 | 6,394,573 | 6,622,923 |
| 6,747,760 | 6,921,144 | 10/884,881 | 7,092,112 | 7,192,106 | 11/039,866 |
| 7,173,739 | 6,986,560 | 7,008,033 | 11/148,237 | 7,195,328 | 7,182,422 |
| 10/854,521 | 10/854,522 | 10/854,488 | 7,281,330 | 10/854,503 | 7,328,956 |
| 10/854,509 | 7,188,928 | 7,093,989 | 10/854,497 | 10/854,495 | 10/854,498 |
| 10/854,511 | 10/854,512 | 10/854,525 | 10/854,526 | 10/854,516 | 7,252,353 |
| 10/854,515 | 7,267,417 | 10/854,505 | 10/854,493 | 7,275,805 | 7,314,261 |
| 10/854,490 | 7,281,777 | 7,290,852 | 10/854,528 | 10/854,523 | 10/854,527 |
| 10/854,524 | 10/854,520 | 10/854,514 | 10/854,519 | 10/854,513 | 10/854,499 |
| 10/854,501 | 7,266,661 | 7,243,193 | 10/854,518 | 10/854,517 | 10/934,628 |
| 7,163,345 | 10/760,254 | 10/760,210 | 7,364,263 | 7,201,468 | 7,360,868 |
| 10/760,249 | 7,234,802 | 7,303,255 | 7,287,846 | 7,156,511 | 10/760,264 |
| 7,258,432 | 7,097,291 | 10/760,222 | 10/760,248 | 7,083,273 | 10/760,192 |
| 10/760,203 | 10/760,204 | 10/760,205 | 10/760,206 | 10/760,267 | 10/760,270 |
| 7,198,352 | 7,364,264 | 7,303,251 | 7,201,470 | 7,121,655 | 7,293,861 |
| 7,232,208 | 7,328,985 | 7,344,232 | 7,083,272 | 11/014,764 | 11/014,763 |
| 7,331,663 | 7,360,861 | 7,328,973 | 11/014,760 | 11/014,757 | 7,303,252 |
| 7,249,822 | 11/014,762 | 7,311,382 | 7,360,860 | 7,364,257 | 11/014,736 |
| 7,350,896 | 11/014,758 | 11/014,725 | 7,331,660 | 11/014,738 | 11/014,737 |
| 7,322,684 | 7,322,685 | 7,311,381 | 7,270,405 | 7,303,268 | 11/014,735 |
| 11/014,734 | 11/014,719 | 11/014,750 | 11/014,749 | 7,249,833 | 11/014,769 |
| 11/014,729 | 7,331,661 | 11/014,733 | 7,300,140 | 7,357,492 | 7,357,493 |
| 11/014,766 | 11/014,740 | 7,284,816 | 7,284,845 | 7,255,430 | 11/014,744 |
| 7,328,984 | 7,350,913 | 7,322,671 | 11/014,718 | 11/014,717 | 11/014,716 |
| 11/014,732 | 7,347,534 | 11/097,268 | 11/097,185 | 11/097,184 | |

The disclosures of these applications and patents are incorporated herein by reference.

BACKGROUND OF THE INVENTION

Inkjet printers are commonplace in homes and offices. However, all commercially available inkjet printers suffer from slow print speeds, because the printhead must scan across a stationary sheet of paper. After each sweep of the printhead, the paper advances incrementally until a complete printed page is produced.

It is a goal of inkjet printing to provide a stationary pagewidth printhead, whereby a sheet of paper is fed continuously past the printhead, thereby increasing print speeds greatly. The present Applicant has developed many different types of pagewidth inkjet printheads using MEMS technology, some of which are described in the patents and patent applications listed in the above cross reference list.

The contents of these patents and patent applications are incorporated herein by cross-reference in their entirety.

Notwithstanding the technical challenges of producing a pagewidth inkjet printhead, a crucial aspect of any inkjet printing is maintaining the printhead in an operational printing condition throughout its lifetime. A number of factors may cause an inkjet printhead to become non-operational and it is important for any inkjet printer to include a strategy for preventing printhead failure and/or restoring the printhead to an operational printing condition in the event of failure. Printhead failure may be caused by, for example, printhead face flooding, dried-up nozzles (due to evaporation of water from the nozzles—a phenomenon known in the art as decap), or particulates fouling nozzles.

Particulates, in the form of paper dust, are a particular problem in high-speed pagewidth printing. This is because the paper is typically fed at high speed over a paper guide and past the printhead. Frictional contact of the paper with the paper guide generates large quantities of paper dust compared to traditional scanning inkjet printheads, where paper is fed much more slowly. Hence, pagewidth printheads tend to accumulate paper dust on their ink ejection face during printing. This accumulation of paper dust is highly undesirable.

In the worst case scenario, paper dust blocks nozzles on the printhead, preventing those nozzles from ejecting ink. More usually, paper dust overlies nozzles and partially covers nozzle apertures. Nozzle apertures that are partially covered or blocked produce misdirected ink droplets during printing—the ink droplets are deflected from their intended trajectory by particulates on the ink ejection face. Misdirects are highly undesirable and may result in acceptably low print quality.

One measure that has been used for maintaining printheads in an operational condition is sealing the printhead, which prevents the ingress of particulates and also prevents evaporation of ink from nozzles. Commercial inkjet printers are typically supplied with a sealing tape across the printhead, which the user removes when the printer is installed for use. The sealing tape protects the primed printhead from particulates and prevents the nozzles from drying up during transit. Sealing tape also controls flooding of ink over the printhead face.

Aside from one-time use sealing tape on new printers, sealing has also been used as a strategy for maintaining printheads in an operational condition during printing. In some commercial printers, a gasket-type sealing ring and cap engages around a perimeter of the printhead when the printer is idle. A vacuum may be connected to the sealing cap and used to suck ink from the nozzles, unblocking any nozzles that have dried up. However, whilst sealing/vacuum caps may prevent the ingress of particulates from the atmosphere, such measures do not remove particulates already built up on the printhead.

In order to remove flooded ink from a printhead after vacuum flushing, prior art maintenance stations typically employ a rubber squeegee, which is wiped across the printhead. Particulates are removed from the printhead by flotation into the flooded ink and the squeegee removes the flooded ink having particulates dispersed therein.

However, rubber squeegees have several shortcomings when used with MEMS pagewidth printheads. A typical MEMS printhead has a nozzle plate comprised of a hard, durable material such as silicon nitride, silicon oxide, aluminium nitride etc. Moreover, the nozzle plate is typically relatively abrasive due to etched features on its surface. On the one hand, it is important to protect the nozzle plate, comprising sensitive nozzle structures, from damaging exposure to the shear forces exerted by a rubber squeegee. On the other hand, it is equally important that a rubber squeegee should not be damaged by contact with the printhead and reduce its cleaning efficacy.

Therefore, it would be desirable to provide an inkjet printhead maintenance station, which does not rely on a rubber squeegee wiping across the nozzle plate to remove flood ink and particulates. It would further be desirable to provide an inkjet printhead maintenance station, which removes flooded ink and particulates from the nozzle plate without the nozzle plate coming into contact with any cleaning surface.

It would further be desirable to provide an ink jet printhead maintenance station that is simple in design, does not consume large amounts power and can be readily incorporated into a desktop printer.

SUMMARY OF THE INVENTION

In a first aspect, there is provided a method of maintaining a printhead in an operable condition, said method comprising the steps of:

(a) flooding an ink ejection face of said printhead with ink; and (b) removing said ink by blasting air across said face.

In a second aspect, there is provided a printhead maintenance station for maintaining a printhead in an operable condition, said maintenance station comprising:

a capper sealingly engageable around said printhead, said capper comprising a constriction member for defining a blast channel adjacent an ink ejection face of said printhead;

an air inlet valve in fluid communication with said capper;

a vacuum system in fluid communication with said capper; and an engagement mechanism for moving said capper between a first position in which said capper is sealingly engaged around said printhead and a second position in which said capper is disengaged from around said printhead.

In a third aspect, there is provided a method of maintaining a printhead in an operable condition, said method comprising the steps of:

(i) providing a printhead maintenance station, said maintenance station comprising:

a capper sealingly engageable around said printhead, said capper comprising a constriction member for defining a blast channel adjacent an ink ejection face of said printhead;

a vacuum system in fluid communication with said capper;

an air inlet valve in fluid communication with said capper; and an engagement mechanism for moving said capper between a first position in which said capper is sealingly engaged around said printhead and a second position in which said capper is disengaged from around said printhead;

(ii) moving said capper into said first position such that said constriction member is spaced apart from said face, thereby defining said blast channel;

(iii) generating a vacuum over said face using said vacuum system, thereby purging ink from printhead nozzles onto said face; and (iv) opening said air inlet valve, thereby blasting air through said blast channel and removing ink from said face.

In a fourth aspect, there is provided a printhead maintenance assembly comprising:

a printhead; and a printhead maintenance station for maintaining said printhead in an operable condition, said maintenance station comprising:

a capper sealingly engageable around said printhead, said capper comprising a constriction member for defining a blast channel adjacent an ink ejection face of said printhead;

an air inlet valve in fluid communication with said capper;

a vacuum system in fluid communication with said capper; and an engagement mechanism for moving said capper between a first position in which said capper is sealingly engaged around said printhead and a second position in which said capper is disengaged from around said printhead.

In a fifth aspect, there is provided a capper for a printhead maintenance station, said capper comprising:

a capping chamber sealingly engageable around a printhead;

a constriction member positioned in said capper chamber, said constriction member dividing said capper chamber into an air inlet channel and a vacuum channel, said constriction member also defining a blast channel adjacent an ink ejection face of said printhead when said capping chamber is sealingly engaged around said printhead;

an air inlet defined in a wall of said capping chamber, said air inlet opening into said air inlet channel; and a vacuum aperture defined in a wall of said capping chamber, said vacuum aperture opening into said vacuum channel.

The maintenance station and method of the present application advantageously provide total maintenance of the printhead, including purging decapped nozzles and removing flooded ink on the ink ejection face after the purge. It is particularly advantageous that a separate squeegee-cleaning mechanism is not required to clean flooded ink from the printhead face—both purging and cleaning are performed with the capper engaged around the printhead, which simplifies printhead maintenance operations.

Moreover, the maintenance station and method of the present application advantageously avoid potentially damaging contact of the printhead with an external cleaning device. Hence, unlike prior art squeegee-cleaning methods, the air blasting employed by the present invention does not impart significant shear forces across the printhead and does not damage sensitive MEMS nozzle structures.

In some embodiments of the invention, the air blast is provided without the need for high-powered pumps. By providing a constricted blast channel adjacent the printhead, a high velocity of air flow is generated. Furthermore, the use of a vacuum reservoir, which is charged during purging and discharged during air blasting, further reduces the power requirements of the vacuum system. With such low power requirements, the maintenance station of the present application may be readily incorporated into desktop printers, such as pagewidth inkjet printers.

Optionally, the face is flooded by suction, which purges ink from nozzles in the printhead. The suction purges nozzles which may have become blocked or decapped, flooding the ink onto the ink ejection face of the printhead.

Typically, suction is provided via a capper, which is sealingly engaged around the printhead during printhead maintenance. A perimeter gasket (e.g. rubber gasket) on the capper may be provided for sealing engagement around the printhead. The capper typically takes the form of an elongate capping chamber which can seal around the entire printhead. The capping chamber optionally has an air inlet and a vacuum aperture defined in a wall thereof. The air inlet communicates with an air inlet valve while the vacuum aperture communicates with the vacuum system. The vacuum system optionally comprises a vacuum pump, and is used to flood the ink ejection face by generating a vacuum above the face.

Optionally, air is blasted through a blast channel adjacent the ink ejection face. Typically, the blast channel is defined by a constriction member spaced apart from the face. The constriction member provides a constricted blast channel, which has the effect of accelerating air flow across the ink ejection face according to Bernoulli's law. Optionally, air flow rates of 2 to 10, 3 to 8 or 5 to 7 liters per second may be provided. Optionally, the constriction member is spaced less than 2 mm, less than 1 mm, less than 0.5 mm or less than 0.3 mm from the ink ejection face.

Optionally, the constriction member is substantially coextensive with the printhead, ensuring that the whole length of the printhead receives an air blast across its width.

Typically, the constriction member forms part of the capper so that the capper can perform the dual functions of suction purging and air blasting. Optionally, the constriction member divides the capping chamber into an air inlet channel and a vacuum channel.

Optionally, air is blasted through the blast channel by releasing a vacuum above the printhead to the atmosphere. This is usually achieved by opening an air inlet valve in fluid communication with the capper so that air rushes into the capper via an air inlet channel and blasts through the blast channel into a vacuum channel.

Optionally, the vacuum system and the air inlet valve are arranged to control a direction of air flow through the blast channel. For example, by suitable positioning of an air inlet valve connection and vacuum connection on the capper, the air flow through the blast channel may be varied. Optionally, air flows transversely across the printhead face. Optionally, the air flow buffets into a wire bond encapsulant bonded along a longitudinal edge of the printhead. An advantage of this arrangement is that it minimizes the risk of ink becoming trapped in a 'dead space' where the encapsulant meets the printhead.

Optionally, the vacuum system further comprises a vacuum reservoir. The reservoir is charged with a vacuum either before or during suction purging of the printhead nozzles. During air blasting the vacuum reservoir is discharged. Accordingly, the vacuum reservoir advantageously allows a high velocity air flow through the blast channel, without the need for a high-powered vacuum pump.

Optionally, the vacuum system further comprises an ink dump for receiving ink removed from the ink ejection face during air blasting. The vacuum system typically directs the removed ink into the ink dump during air blasting. In some embodiments, the ink dump may be contained in the vacuum reservoir.

Optionally, the printhead is mounted on a support, which typically comprises an ink manifold for supplying ink to the printhead. Optionally, the support may further comprise a wirebond encapsulant bonded to the ink manifold and/or a paper guide attached to the ink manifold. Optionally, the capper sealingly engages with the support.

Optionally, the support and the capper comprise complementary alignment features for locating the capper into a printhead maintenance position. The alignment features advantageously ensure proper alignment of the capper around the printhead and, in particular, proper positioning of the constriction member so as to define the blast channel.

Optionally, the capper is disengaged from around the printhead after each maintenance cycle of purging and air blasting. Optionally, an area around the printhead is dabbed after disengagement of the capper, using a dabbing device. The dabbing device may comprise, for example, a microfibre film or an absorbent block of wicking material. Dabbing may be used to remove any ink from around the printhead (e.g. on wire bond encapsulant or on a printhead support), which has not been removed by the air blasting.

The invention has been developed primarily for use with a MEMS pagewidth inkjet printhead. However, the invention is equally applicable to any type of printhead where remedial measures are required to maintain the printhead in an operable condition. For example, the invention may be used in connection with standard scanning inkjet printheads in order to avoid printhead damage during maintenance.

In a first aspect the present invention provides a printhead maintenance assembly for maintaining a printhead in an operable condition, said maintenance assembly comprising:

(i) a printhead assembly comprising:

a printhead having an ink ejection face, said face having a first edge portion and a second edge portion opposite said first edge portion; and a film guide sealingly bonded to said first edge portion, said film guide being positioned to guide a film through a transfer zone, said transfer zone being defined by a plane spaced apart from said face;

and (ii) an ink transport assembly comprising:

a film for transporting ink away from said printhead; and a transport mechanism for feeding said film through said transfer zone and away from said printhead, said transport mechanism feeding said film in a directional sense which is from said first edge portion to said second edge portion;

wherein, in use, said film contacts with said film guide thereby forming a cavity defined at least partially by said film, said film guide and said face.

Optionally, said printhead is a pagewidth inkjet printhead.

Optionally, said first and second edge portions are longitudinal edge portions.

Optionally, said film guide is comprised of a solid polymeric material.

Optionally, said film guide encapsulates wire bonds extending from said first edge portion of said printhead.

Optionally, said transfer zone is substantially parallel with said ink ejection face.

Optionally, said transfer zone is less than 1 mm from said face.

Optionally, said film is wetting.

Optionally, said film is an endless loop.

Optionally, a width of said film is substantially coextensive with a length of said printhead.

Optionally, said ink transport assembly further comprises a film cleaner, said transport mechanism being configured to feed said film past said film cleaner.

Optionally, said film cleaner is an absorbent pad positioned remotely from said printhead.

Optionally, said cavity is open-ended at said second edge portion.

Optionally, said ink transport assembly is moveable between a first position in which said film is positioned in said transfer zone and a second position in which said film is positioned remotely from said transfer zone.

In a further aspect there is provided a maintenance assembly, further comprising:

(iii) a face flooding system for flooding ink from said printhead onto said ink ejection face.

Optionally, said face flooding system comprises a pressure system for positively pressurizing an ink reservoir supplying ink to said printhead.

Optionally, said pressure system comprises a control system for controlling an amount and/or a period of pressure applied to said ink reservoir.

Optionally, said printhead assembly further comprises a print media guide for guiding print media past said printhead.

Optionally, said print media guide is moveable between a media-guiding position and a retracted position.

Optionally, said print media guide is positioned on an opposite side of said printhead to said film guide.

In a second aspect the present invention provides a method of maintaining a printhead in an operable condition, said method comprising the steps of:

(i) providing a printhead assembly, said printhead assembly comprising:

a printhead having an ink ejection face, said face having a first edge portion and a second edge portion opposite said first edge portion; and a film guide sealingly bonded to said first edge portion, said film guide being positioned to guide a film through a transfer zone, said transfer zone being defined by a plane spaced apart from said face;

(ii) positioning at least part of a film in said transfer zone and in contact with said film guide, thereby forming a cavity defined at least partially by said film, said film guide and said face; and (iii) feeding said film through said transfer zone and away from said printhead, thereby removing ink from said cavity, said film being fed in a directional sense which is from said first edge portion to said second edge portion.

Optionally, said printhead is a pagewidth inkjet printhead.

Optionally, said first and second edge portions are longitudinal edge portions.

Optionally, said film guide is comprised of a solid polymeric material.

Optionally, said film guide encapsulates wire bonds extending from said first edge portion of said printhead.

Optionally, said transfer zone is substantially parallel with said ink ejection face.

Optionally, said transfer zone is less than 2 mm from said face.

Optionally, said film is wetting.

Optionally, said film is an endless loop.

Optionally, a width of said film is substantially coextensive with a length of said printhead.

Optionally, said film is fed past a film cleaner after being fed through said transfer zone.

Optionally, said film cleaner is an absorbent pad positioned remotely from said printhead.

Optionally, said cavity is open-ended at said second edge portion.

Optionally, said film is moveable between a first position in which said film is positioned in said transfer zone and a second position in which said film is positioned remotely from said transfer zone Optionally, said face is flooded with ink from said printhead prior to feeding said film through said transfer zone.

Optionally, said face is flooded by positively pressurizing an ink reservoir supplying ink to said printhead.

Optionally, an amount and/or a period of pressure applied to said ink reservoir is controlled.

Optionally, said printhead assembly further comprises a print media guide for guiding print media past said printhead.

Optionally, said print media is guide is moved out of a media-guiding position prior to positioning said film in said transfer zone.

Optionally, said print media is guide is moved into a media-guiding position after feeding said film through said transfer zone.

In a third aspect the present invention provides a method of removing flooded ink from an ink ejection face of a printhead, said method comprising transferring said ink onto a film moving past said face, wherein said film does not contact said face.

Optionally, said film is guided past said face using a film guide.

Optionally, at least part of said face, said film and said film guide form a cavity for containing said ink.

Optionally, said cavity is open-ended.

Optionally, said printhead is a pagewidth inkjet printhead.

Optionally, said film guide is comprised of a solid polymeric material.

Optionally, said film guide encapsulates wire bonds extending from said printhead.

Optionally, said film is moved past said face substantially parallel therewith.

Optionally, said film is less than 2 mm from said face.

Optionally, said film is wetting.

Optionally, a width of said film is substantially coextensive with a length of said printhead.

Optionally, said film is fed past a film cleaner after being fed past said face.

Optionally, said film cleaner is an absorbent pad positioned remotely from said printhead.

Optionally, ink is flooded across said face prior to moving said film past said face Optionally, said face is flooded by positively pressurizing an ink reservoir supplying ink to said printhead.

Optionally, an amount and/or a period of pressure applied to said ink reservoir is controlled.

In a fourth aspect the present invention provides a method of removing particulates from an ink ejection face of a printhead, said method comprising the steps of:

(a) flooding said face with ink from said printhead, thereby dispersing said particulates into said flooded ink; and (b) transferring said flooded ink, including said particulates, onto a film moving past said face, wherein said film does not contact said face.

Optionally, said film is guided past said face using a film guide.

Optionally, at least part of said face, said film and said film guide form a cavity for containing said ink.

Optionally, said cavity is open-ended.

Optionally, said printhead is a pagewidth inkjet printhead.

Optionally, said film guide is comprised of a solid polymeric material.

Optionally, said film guide encapsulates wire bonds extending from said printhead.

Optionally, said film is moved past said face substantially parallel therewith.

Optionally, said film is less than 2 mm from said face.

Optionally, said film is wetting.

Optionally, a width of said film is substantially coextensive with a length of said printhead.

Optionally, said film is fed past a film cleaner after being fed past said face.

Optionally, said film cleaner is an absorbent pad positioned remotely from said printhead.

Optionally, said face is flooded with ink by positively pressurizing an ink reservoir supplying ink to said printhead.

Optionally, an amount and/or a period of pressure applied to said ink reservoir is controlled.

In a fifth aspect the present invention provides a method of maintaining a printhead in an operable condition, said method comprising the steps of:

(a) flooding an ink ejection face of said printhead with ink; and (b) removing said ink by blasting air across said face.

Optionally, said face is flooded by suction.

Optionally, said suction purges nozzles in said printhead.

Optionally, a capper is sealingly engaged around said printhead during printhead maintenance.

Optionally, said capper is disengaged from around said printhead during printing.

Optionally, said capper comprises a perimeter gasket for sealing engagement around said printhead.

Optionally, said capper is in fluid communication with a vacuum system, said vacuum system flooding said face by generating a vacuum above said face.

Optionally, said vacuum system comprises a vacuum pump.

Optionally, air is blasted through a blast channel adjacent said face.

Optionally, said blast channel is defined by a constriction member spaced apart from said face, said constriction member constricting air flow across said face.

Optionally, said constriction member is substantially coextensive with said printhead.

Optionally, said capper comprises a constriction member, said constriction member defining a blast channel adjacent said printhead when said capper is engaged around said printhead.

Optionally, air is blasted through said blast channel by releasing said vacuum to atmosphere.

Optionally, said capper is in fluid communication with an air inlet valve, said vacuum system, said constriction member and said air inlet valve cooperating to blast air through said blast channel.

Optionally, said vacuum system and said air inlet valve are arranged to control a direction of air flow through said blast channel.

Optionally, said vacuum system further comprises a vacuum reservoir, said reservoir being charged before flooding of said face.

Optionally, said reservoir is discharged during air blasting.

Optionally, said vacuum system further comprises an ink dump for receiving ink removed from said face during said air blast.

Optionally, said vacuum system directs said removed ink into said ink dump during air blasting.

Optionally, said printhead is a pagewidth inkjet printhead.

In a sixth aspect the present invention provides a printhead maintenance station for maintaining a printhead in an operable condition, said maintenance station comprising:

a capper sealingly engageable around said printhead, said capper comprising a constriction member for defining a blast channel adjacent an ink ejection face of said printhead;

an air inlet valve in fluid communication with said capper;

a vacuum system in fluid communication with said capper; and an engagement mechanism for moving said capper between a first position in which said capper is sealingly engaged around said printhead and a second position in which said capper is disengaged from around said printhead.

Optionally, said capper comprises a perimeter gasket for sealing engagement around said printhead.

Optionally, said vacuum system comprises a vacuum pump.

Optionally, said vacuum system is configured for generating a vacuum above said face, said vacuum purging ink from printhead nozzles onto said face.

Optionally, in said first position, said constriction member is spaced apart from said face, thereby defining said blast channel.

Optionally, said constriction member is spaced less than 0.5 mm from said face.

Optionally, said constriction member is substantially coextensive with said printhead.

Optionally, said capper comprises an air inlet port and a vacuum port.

Optionally, said vacuum system, said air inlet valve and said constriction member cooperate for blasting air through said blast channel, thereby removing ink from said face.

Optionally, said vacuum system and said air inlet valve are arranged to control a direction of air flow through said blast channel.

Optionally, said printhead comprises a wire bond encapsulant along one edge, and said air flow buffets into said encapsulant.

Optionally, said air flows transversely across said face.

Optionally, said vacuum system further comprises a vacuum reservoir.

Optionally, said vacuum system is configured for charging said vacuum reservoir before purging of said printhead nozzles.

Optionally, said vacuum system is configured for discharging said vacuum reservoir during air blasting.

Optionally, said vacuum system further comprises an ink dump for receiving ink removed from said face during said air blasting.

Optionally, said vacuum system is configured for directing said removed ink into said ink dump during air blasting.

Optionally, said printhead is a pagewidth inkjet printhead.

In a seventh aspect the present invention provides a method of maintaining a printhead in an operable condition, said method comprising the steps of:

(i) providing a printhead maintenance station, said maintenance station comprising:

a capper sealingly engageable around said printhead, said capper comprising a constriction member for defining a blast channel adjacent an ink ejection face of said printhead;

a vacuum system in fluid communication with said capper;

an air inlet valve in fluid communication with said capper; and an engagement mechanism for moving said capper between a first position in which said capper is sealingly engaged around said printhead and a second position in which said capper is disengaged from around said printhead;

(ii) moving said capper into said first position such that said constriction member is spaced apart from said face, thereby defining said blast channel;

(iii) generating a vacuum over said face using said vacuum system, thereby purging ink from printhead nozzles onto said face; and (iv) opening said air inlet valve, thereby blasting air through said blast channel and removing ink from said face.

Optionally, the method comprising the further step of:

(v) moving said capper into said second position.

Optionally, the method comprising the further step of:

(vi) dabbing ink from around said printhead.

Optionally, said capper comprises a perimeter gasket for sealing engagement around said printhead.

Optionally, said vacuum system comprises a vacuum pump.

Optionally, said constriction member is spaced less than 0.5 mm from said face in said first position.

Optionally, said constriction member is substantially coextensive with said printhead.

Optionally, said vacuum system and said air inlet valve are arranged to control a direction of air flow through said blast channel.

Optionally, said printhead comprises a wire bond encapsulant along one edge, and said air flow buffets into said encapsulant.

Optionally, said air flows transversely across said face.

Optionally, said vacuum system further comprises a vacuum reservoir.

Optionally, said vacuum reservoir is charged prior to said purging.

Optionally, said vacuum reservoir is discharged during said air blasting.

Optionally, said vacuum system further comprises an ink dump for receiving ink removed from said face during said air blasting.

Optionally, said vacuum system directs said removed ink into said ink dump during air blasting.

Optionally, said printhead is a pagewidth inkjet printhead.

In an eighth aspect the present invention provides a printhead maintenance assembly comprising:

a printhead; and a printhead maintenance station for maintaining said printhead in an operable condition, said maintenance station comprising:

a capper sealingly engageable around said printhead, said capper comprising a constriction member for defining a blast channel adjacent an ink ejection face of said printhead;

an air inlet valve in fluid communication with said capper;

a vacuum system in fluid communication with said capper; and an engagement mechanism for moving said capper between a first position in which said capper is sealingly engaged around said printhead and a second position in which said capper is disengaged from around said printhead.

Optionally, said capper comprises a perimeter gasket for sealing engagement around said printhead.

Optionally, said vacuum system comprises a vacuum pump.

Optionally, said vacuum system is configured for generating a vacuum above said face, said vacuum purging ink from printhead nozzles onto said face.

Optionally, in said first position, said constriction member is spaced apart from said face, thereby defining said blast channel.

Optionally, said constriction member is spaced less than 0.5 mm from said face.

Optionally, said constriction member is substantially coextensive with said printhead.

Optionally, said capper comprises an air inlet port and a vacuum port.

Optionally, said vacuum system, said air inlet valve and said constriction member cooperate for blasting air through said blast channel, thereby removing ink from said face.

Optionally, said vacuum system and said air inlet valve are arranged to control a direction of air flow through said blast channel.

Optionally, said printhead comprises a wire bond encapsulant along one edge, and said air flow buffets into said encapsulant.

Optionally, said vacuum system further comprises a vacuum reservoir.

Optionally, said vacuum system is configured for charging said vacuum reservoir before purging of said printhead nozzles.

Optionally, said vacuum system is configured for discharging said vacuum reservoir during air blasting.

Optionally, said vacuum system further comprises an ink dump for receiving ink removed from said face during said air blasting.

Optionally, said vacuum system is configured for directing said removed ink into said ink dump during air blasting.

Optionally, said printhead is a pagewidth inkjet printhead.

Optionally, said printhead is mounted on a support.

Optionally, said capper is sealingly engageable with said support.

Optionally, said support and said capper comprise complementary alignment features for locating said capper into said first position.

In a ninth aspect the present invention provides a capper for a printhead maintenance station, said capper comprising:

a capping chamber sealingly engageable around a printhead;

a constriction member positioned in said capper chamber, said constriction member dividing said capper chamber into an air inlet channel and a vacuum channel, said constriction member also defining a blast channel adjacent an ink ejection face of said printhead when said capping chamber is sealingly engaged around said printhead;

an air inlet defined in a wall of said capping chamber, said air inlet opening into said air inlet channel; and a vacuum aperture defined in a wall of said capping chamber, said vacuum aperture opening into said vacuum channel.

Optionally, said capping chamber comprises a perimeter gasket for sealing engagement around said printhead.

Optionally, said air inlet is in fluid communication with an air inlet valve.

Optionally, said vacuum aperture is in fluid communication with a vacuum system.

Optionally, said vacuum system is configured for generating a vacuum above said face, said vacuum purging ink from printhead nozzles onto said face.

Optionally, said constriction member is spaced apart from said face, thereby defining said blast channel, when said capping chamber is engaged around said printhead.

Optionally, said constriction member is spaced less than 0.5 mm from said face.

Optionally, said constriction member is substantially coextensive with said printhead.

Optionally, said vacuum system, said air inlet valve and said constriction member cooperate for blasting air through said blast channel, thereby removing ink from said face.

Optionally, said vacuum system and said air inlet valve are arranged to control a direction of air flow through said blast channel.

Optionally, said printhead comprises a wire bond encapsulant along one edge, and said air flow buffets into said encapsulant.

Optionally, capper further comprising an air inlet port and a vacuum port.

Optionally, said printhead is a pagewidth inkjet printhead.

Optionally, said printhead is mounted on a support.

Optionally, said capping chamber is sealingly engageable with said support.

Optionally, said capping chamber comprises at least one first alignment feature complementary with at least one second alignment feature on said support, said alignment features locating said capping chamber into sealing engagement around said printhead.

BRIEF DESCRIPTION OF THE DRAWINGS

Specific forms of the present invention will be now be described in detail, with reference to the following drawings, in which.

DETAILED DESCRIPTION OF SPECIFIC EMBODIMENTS

Figure 1:
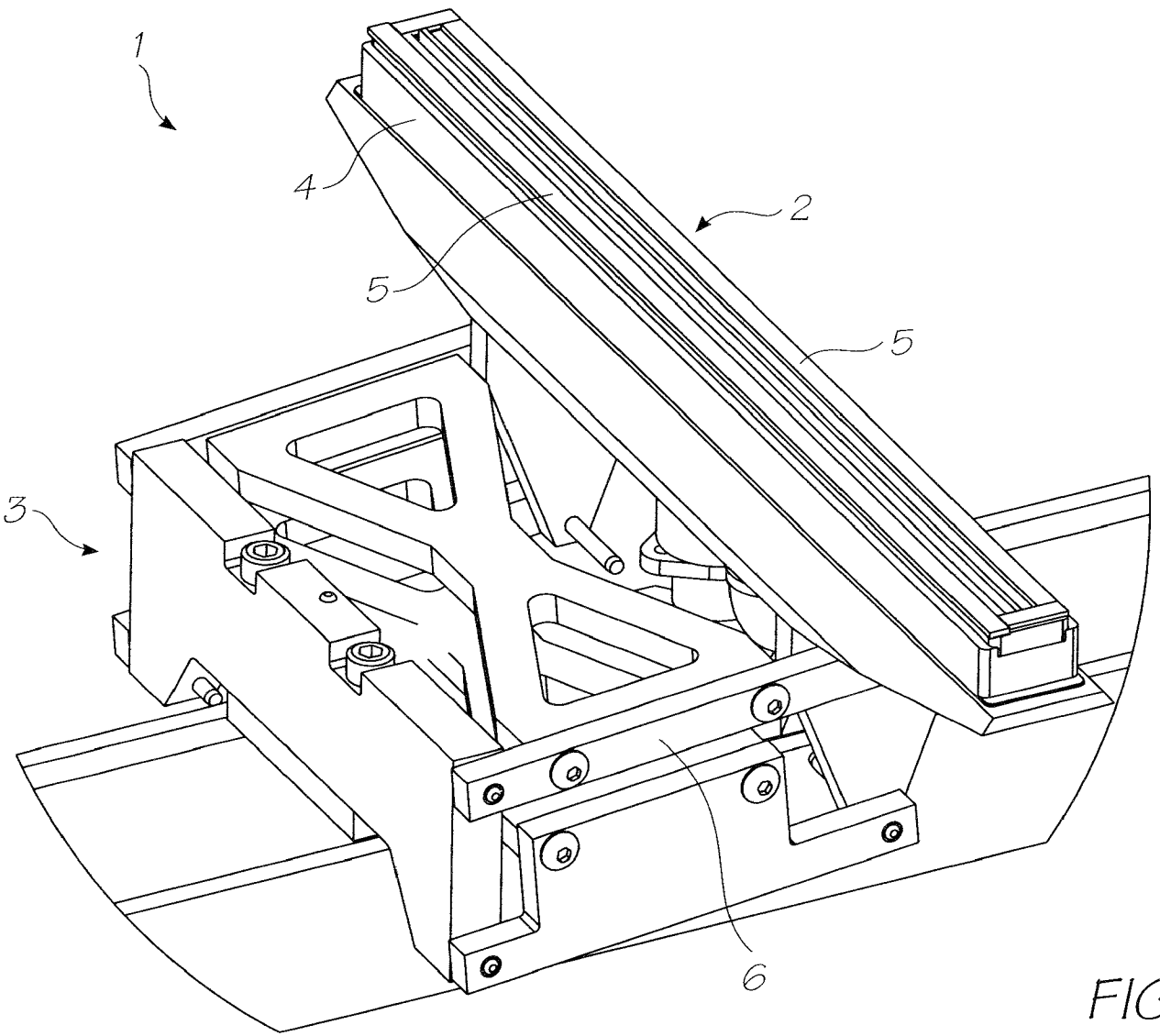
FIG. 1 is a front perspective view of a capper and engagement mechanism for a printhead maintenance station according to the present invention.
Figure 2:
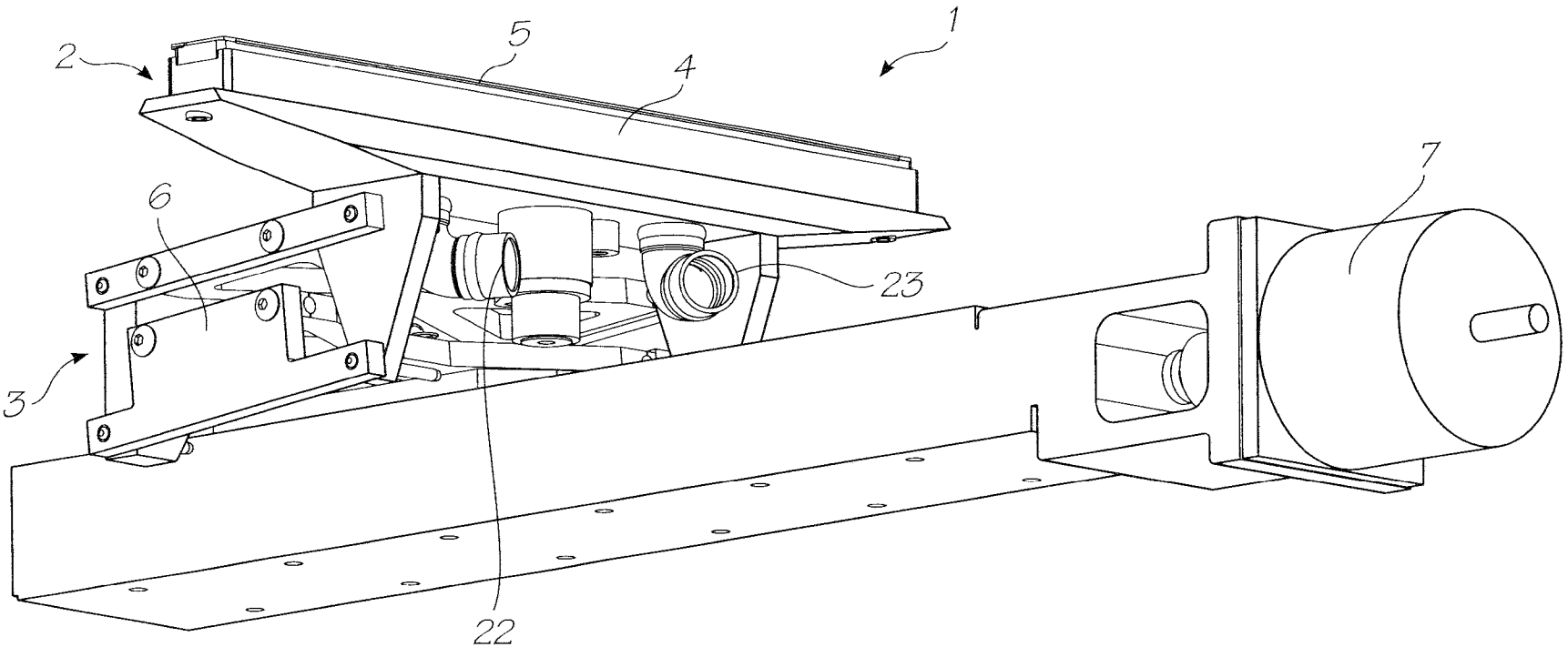
FIG. 2 is a rear perspective view of the capper and engagement mechanism shown in FIG. 1.

Referring to FIGS. 1 and 2, there is shown part of a printhead maintenance station 1 comprising a capper 2 and an engagement mechanism 3. The capper 2 takes the form of an elongate capping chamber 4 having a perimeter gasket 5 fixed around one end. The capping chamber 4 with gasket 5 is configured to fit and form a seal around a pagewidth printhead 10 (see FIGS. 3 and 4).

In the embodiment shown, the engagement mechanism 3 takes the form of a pantograph 6, which raises and lowers the capper 2 into sealing engagement and out of engagement from around the printhead 10. The pantograph 6 is actuated using a motor 7, which raises and lowers the pantograph via a cam arrangement (not shown). Other types of engagement mechanism suitable for raising and lowering the capper 2 will, of course, be readily apparent to the person skilled in the art.

Figure 4:
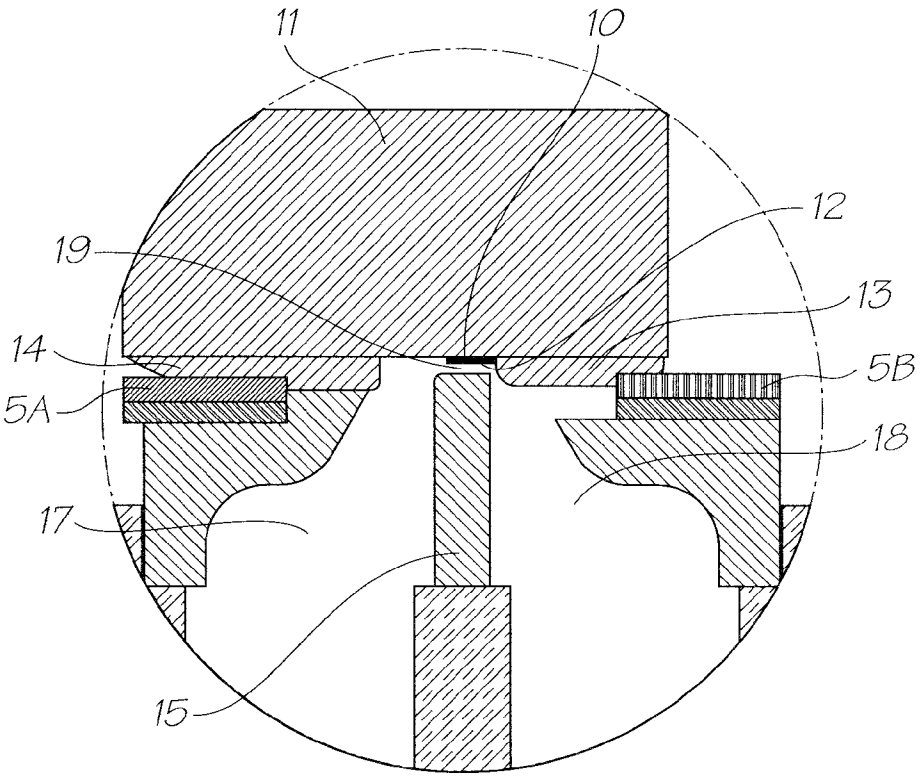
FIG. 4 is an enlarged view of the capper and printhead assembly shown in FIG. 3.
Figure 3:
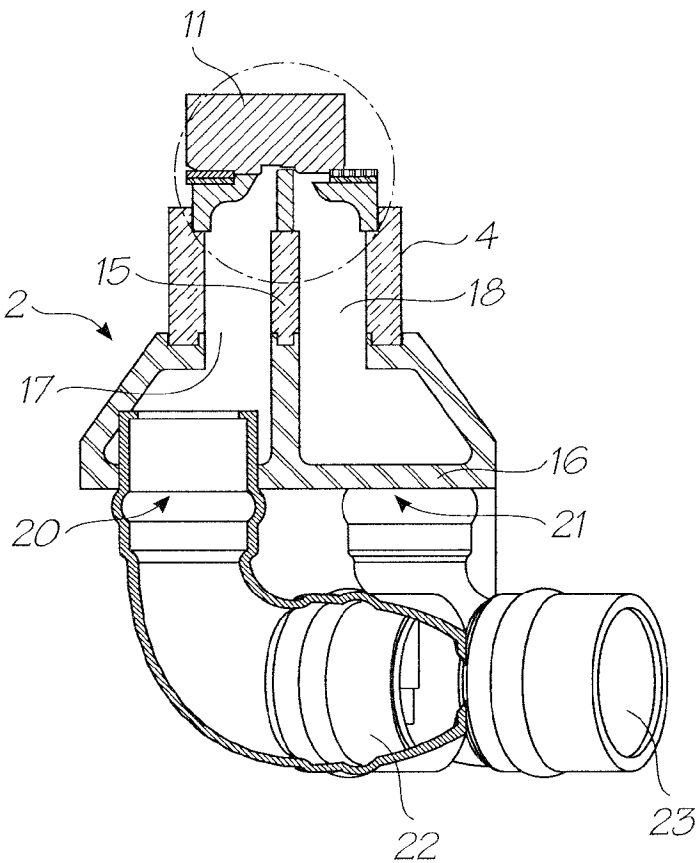
FIG. 3 is a transverse section of the capper engaged with a printhead assembly.

Referring to FIGS. 3 and 4, the capper 2, engaged around the printhead 10, is shown in more detail. The printhead 10 is mounted on an ink manifold 11, which supplies ink to a backside of the printhead. A wirebond encapsulant 13 is bonded to the ink manifold 11 and extends from one side of the printhead 10. The encapsulant 13 protects wirebonds, which connect CMOS circuitry in the printhead 10 to an external microprocessor (not shown). On an opposite side of the printhead 10, a paper guide 14 is attached to the ink manifold 11. During printing, paper is guided over the paper guide 14 and ink is ejected from an ink ejection face 12 of the printhead 10 onto the paper via a plurality of inkjet nozzles (not shown). The capper 2 is disengaged when the printhead 10 is being used for printing.

As shown in FIG. 4, with the capper 2 in its engaged position, the perimeter gasket 5 forms a seal around the printhead 10. Longitudinal sides 5A and 5B of the perimeter gasket 5 sealingly engage with the paper guide 14 and wirebond encapsulant 13 respectively.

A constriction member 15 extends from a base 16 of the capping chamber 4 towards the printhead 10. The constriction member 15 divides the capper chamber 4 into an air inlet channel 17 and a vacuum channel 18. With the capper 2 engaged around the printhead 10, the air inlet channel 17 and the vacuum channel 18 are in fluid communication via a constricted blast channel 19. The constriction member 15 and the ink ejection face 12 together define the width of the blast channel 19 therebetween. Typically, the blast channel 19 has a width of about 0.2 mm.

An air inlet 20 and a vacuum aperture 21 are defined in the base 16 of the capping chamber 4 and are connected to an air inlet port 22 and vacuum port 23 respectively. The air inlet 20 and vacuum aperture 21 open into the air inlet channel 17 and vacuum channel 18 respectively.

The air inlet port 22 is connected via hose to an air inlet valve 30, while the vacuum port 23 is connected via a hose to a vacuum system 31. The air inlet valve 30 and vacuum system 31 cooperate with the capper 2 to purge and clean the printhead 10. The purging and cleaning operations are described in further detail with reference to FIG. 5.

Figure 5:
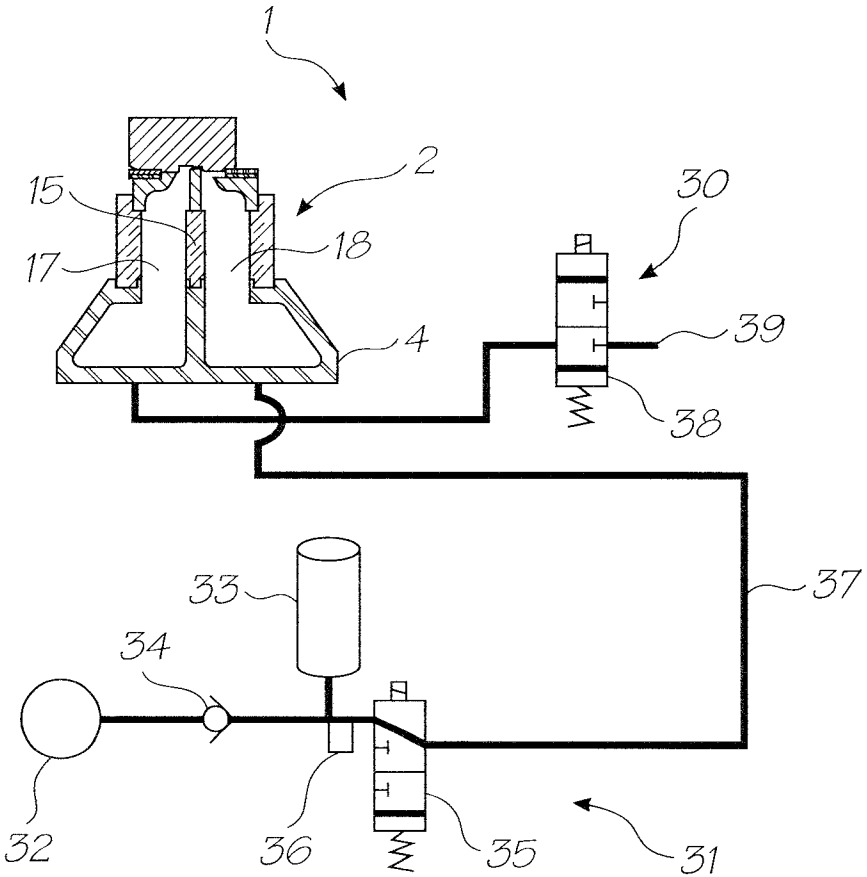
FIG. 5 is a schematic diagram of a fluidics system for the printhead maintenance station.

Referring to FIG. 5, the vacuum system 31 comprises a vacuum pump 32 connected to a vacuum reservoir 33. A check valve 34 between the vacuum pump 32 and the reservoir 33 ensures that the reservoir remains charged after the pump is switched off. The vacuum reservoir 33 is connected to the vacuum channel 18 in the capping chamber 4 via a vacuum line 37 and the vacuum port 23 (not shown in FIG. 5). A first solenoid valve 35 and an ink dump 36 are positioned in the vacuum line 37 between the vacuum reservoir 33 and the capping chamber 4.

The air inlet valve 30 takes the form of a second solenoid valve 38, which is connected to the air inlet channel 17 in the capping chamber 4 via the air inlet port 20 (not shown in FIG. 5). The air inlet valve 30 has an air intake 39, which may receive unfiltered or filtered air from the atmosphere.

At the beginning of a typical printhead maintenance operation, the vacuum reservoir 33, having a volume of about 1 to 1.5 liters, is initially charged with a vacuum. The vacuum reservoir 33 may be charged independently of the capper 2 by switching the first solenoid valve 35 to a charging position (not shown). The vacuum reservoir 33 may, for example, be charged during idle periods or during active printing when the capper 2 is disengaged. The time period for charging the vacuum reservoir 33 may vary, depending on the size of the reservoir and the power of the pump 32. Typically, charging will last for a maximum of about 45 seconds, ensuring that the printhead can be regularly maintained or remediated.

With the vacuum reservoir 33 charged, the capper 2 is engaged around the printhead 10 and the first solenoid valve 35 is opened to the vacuum reservoir, as shown in FIG. 5. Since the capper 2 is sealed around the printhead 10, a negative pressure is generated above the ink ejection face 12 and, as a result, ink floods from printhead nozzles onto the ink ejection face.

Immediately after subjecting the printhead 10 to vacuum (e.g. after about 50 to 500 ms), the second solenoid valve 38 is opened. As a result, air is drawn into the air intake 39 and rushes from the air inlet channel 17 through to the vacuum channel 18 and on into the vacuum system 31. Air is blasted through the blast channel 19 at high velocity due to the small gap (about 0.2 mm) between the constriction member 15 and the ink ejection face 12. Typically, the air flow rate through the blast channel 19 is about 5 to 7 liters per second, which ensures complete removal of flooded ink from the ink ejection face 12 of the printhead 10. Ink removed from the ink ejection face 12 by the air blast is deposited into the ink dump 36.

With the ink purging and cleaning operation complete, the vacuum reservoir 33 is recharged by the vacuum pump 32 in preparation for the next printhead maintenance cycle.

Figure 6:
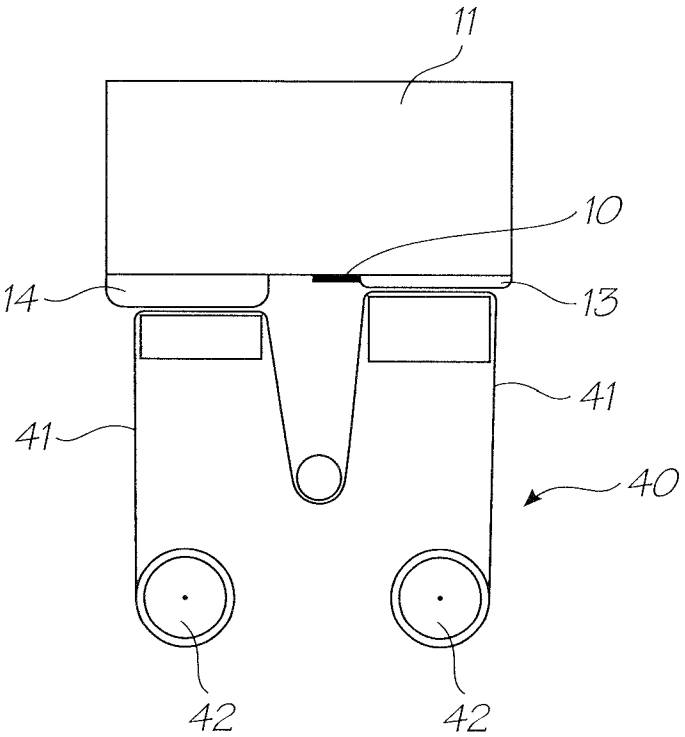
FIG. 6 is a schematic side view of a dabbing device.

After air blasting, any ink remaining on areas surrounding the ink ejection face 12 may be removed by a simple dabbing device. FIG. 6 shows a dabbing device 40 comprising a microfibre film 41, which is fed between a pair of spools 42. The film 41 is used to dab the paper guide 14 and wirebond encapsulant 13 after disengagement of the capper 2. After dabbing, the film 41 is advanced so that a clean portion of film is ready for subsequent dabbing.

The printhead maintenance station 1 as described above may be used for maintaining any type of printhead in an operable condition. It is especially suitable for use with pagewidth MEMS inkjet printheads, where it is desirable to avoid physical contact of the printhead with a cleaning device.

Figure 7:
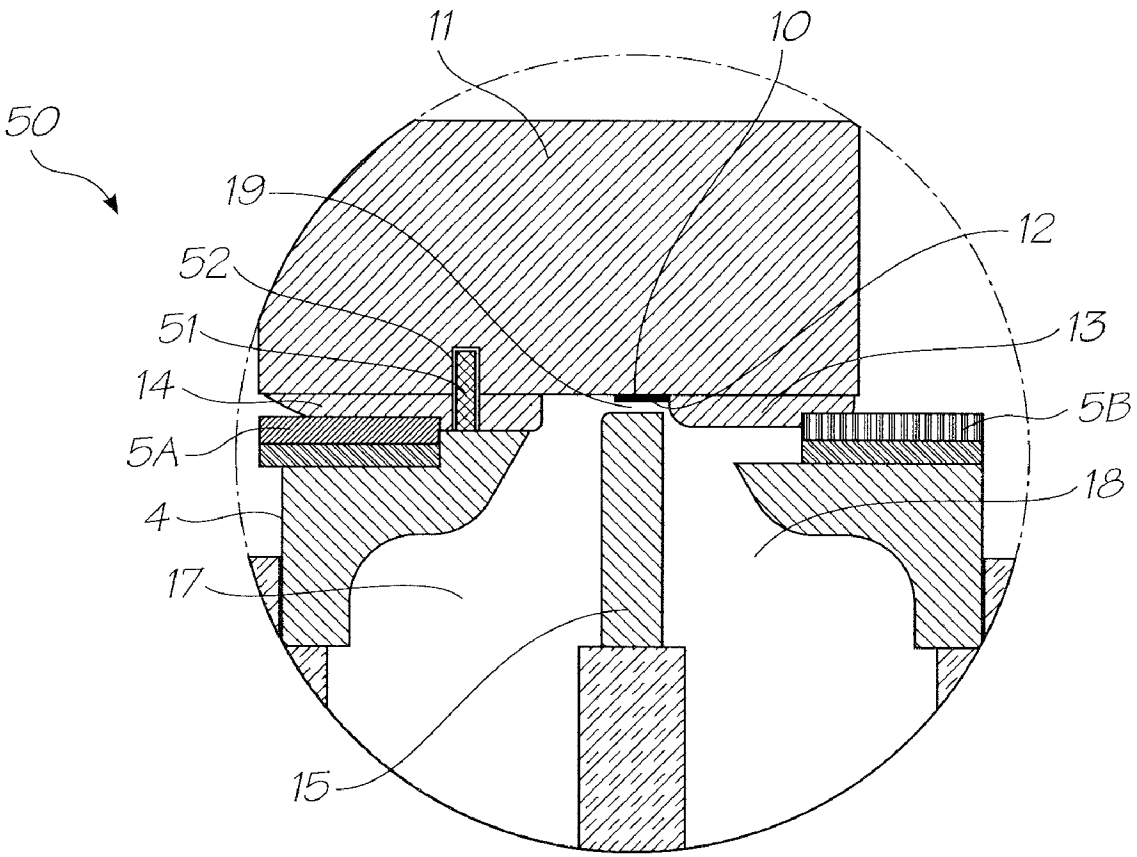
FIG. 7 is a transverse section of an alternative capper engaged with a printhead assembly.

An important aspect of the invention is alignment of the capper 2 with the printhead 10, so that constriction member 15 is accurately positioned to define the blast channel 19. FIG. 7 shows an alternative printhead maintenance assembly 50, wherein the capper 2 and the printhead support have complementary alignment features for aligning the capper into position. Specifically, a locating pin 51 extends from a roof of the capping chamber 4, and engages with a complementary slot 52 in the paper guide 14. It will be appreciated that a plurality of such complementary alignment features may be provided to assist in aligning the capper 2 into its optimum maintenance position.

It will, of course, be appreciated that the present invention has been described purely by way of example and that modifications of detail may be made within the scope of the invention, which is defined by the accompanying claims.

The invention claimed is:

1. A printhead maintenance station for a pagewidth printer, said maintenance station comprising:

a capper having an open-ended capping chamber with a perimeter gasket for operatively engaging with a printhead of the printer to form a protective seal around the printhead;

an engagement mechanism configured to actuate said capper into and out of sealing engagement with the printhead; and a dabbing device with a microfibre film which is operatively fed between a pair of spools to dab only a non-printing portion of the printhead after the capper is disengaged from the printhead.

2. The maintenance station of claim 1, wherein the dabbing mechanism is configured to advance the film after dabbing so that a clean portion of film is ready for subsequent dabbing.

3. The maintenance station of claim 1, wherein the engagement mechanism includes a pantograph actuated via a cam arrangement by means of an electric motor into and out of engagement with the printhead.

4. The maintenance station of claim 1, wherein the capping chamber includes a constriction member which divides the chamber into an air inlet channel and a vacuum channel.

5. The maintenance station of claim 4, wherein the constriction member is configured to define a blast channel between the air inlet channel and the vacuum channel and across the printhead when said capper is engaged with the printhead to facilitate purging of the printhead.

6. The maintenance station of claim 5, wherein the base of the capping chamber defines an air inlet and a vacuum aperture which are operatively connected to an air inlet port and a vacuum port, respectively.

7. The maintenance station of claim 6, wherein the air inlet port is connected to an air hose and the vacuum port is connected via a hose to a vacuum system having an ink dump configured to receive ink purged from the printhead.

* * * * *